US006901876B2

(12) United States Patent
Geriene et al.

(10) Patent No.: US 6,901,876 B2
(45) Date of Patent: Jun. 7, 2005

(54) METHODS AND APPARATUS FOR HULL ATTACHMENT FOR SUBMERSIBLE VEHICLES

(75) Inventors: Marc Geriene, Kenmore, WA (US); Krist Geriene, Kenmore, WA (US)

(73) Assignee: Nova Ray, Inc., Kirkland, WA (US)

( * ) Notice: Subject to any disclaimer, the term of this patent is extended or adjusted under 35 U.S.C. 154(b) by 0 days.

(21) Appl. No.: 10/766,236

(22) Filed: Jan. 28, 2004

(65) Prior Publication Data

US 2005/0066872 A1 Mar. 31, 2005

Related U.S. Application Data

(63) Continuation of application No. 10/072,642, filed on Feb. 6, 2002, now Pat. No. 6,698,373, which is a continuation-in-part of application No. 09/898,777, filed on Jul. 3, 2001, now Pat. No. 6,474,255, which is a continuation of application No. 09/357,537, filed on Jul. 19, 1999, now Pat. No. 6,276,294.

(51) Int. Cl.[7] ..... B63B 21/66

(52) U.S. Cl. ..... 114/244

(58) Field of Search . 114/242, 244, 312; 248/640–643

(56) References Cited

U.S. PATENT DOCUMENTS

| | | | | |
|---|---|---|---|---|
| 3,461,828 A | * | 8/1969 | Bielstein | 114/265 |
| 3,747,138 A | | 7/1973 | Morgan | |
| 3,822,663 A | * | 7/1974 | Boschen, Jr. | 114/293 |
| 3,851,491 A | * | 12/1974 | Mason | 405/188 |
| 4,668,197 A | | 5/1987 | Proto | |

* cited by examiner

*Primary Examiner*—Ed Swinehart
(74) *Attorney, Agent, or Firm*—Black Lowe & Graham, PLLC; Dale C. Barr

(57) ABSTRACT

Methods and apparatus for hull attachment for submersible vehicles are disclosed. In one embodiment, a submersible apparatus includes a hull having an elongated channel, a sliding member moveably disposed in the channel, and a mounting assembly attached to the sliding member. The mounting assembly includes an engagement member selectively engageable between a first position wherein the mounting assembly is moveable along the channel, and a second position wherein the mounting assembly is secured in a fixed position along the channel. The apparatus advantageously permits a wide variety of equipment or devices (e.g. tow point assemblies, wing assemblies, tail assemblies, propulsion units, illumination devices, imaging devices, instrumentation, sensors, etc.) to be adjustably attached to the hull, and provides improved adjustability, maintainability, integrity, reliability, and overall improved mission performance.

20 Claims, 11 Drawing Sheets

METHODS AND APPARATUS FOR HULL ATTACHMENT FOR SUBMERSIBLE VEHICLES

CROSS-REFERENCE TO RELATED APPLICATIONS

This application claims priority to and is a continuation of U.S. patent application Ser. No. 10/072,642 filed Feb. 6, 2002, now U.S. Pat. No. 6,698,373, which claims priority to and is a continuation-in-part of U.S. patent application Ser. No. 09/898,777, filed Jul. 3, 2001, and issued as U.S. Pat. No. 6,474,255 on Nov. 5, 2002, which claims priority to and is a continuation of U.S. patent application Ser. No. 09/357,537, filed Jul. 19, 1999, and issued as U.S. Pat. No. 6,276,294 on Aug. 21, 2001. Each of the above-referenced applications is incorporated by reference in its entirety as if set forth fully herein.

TECHNICAL FIELD

The present invention relates to submersible vehicles, or more particularly, to methods and apparatus for hull attachment for submersible vehicles having improved adjustability, maintainability, integrity, reliability, and overall improved mission performance.

BACKGROUND OF THE INVENTION

Submersible vehicles are presently used for a wide variety of underwater operations, including inspection of telephone lines and pipe lines, exploration for natural resources, performance of bio-mass surveys of marine life, inspection of hulls of surface vessels or other underwater structures, and to search for shipwrecks and sunken relics. Submersible vehicles may be manned or unmanned, and may carry a wide variety of payloads. Furthermore, submersible vehicles may be towed by a surface vessel, or may be equipped with a propulsion unit for autonomous mobility. Overall, submersible vehicles are an important tool in the performance of a wide variety of hydrographic surveys for commercial, ecological, professional, or recreational purposes.

FIG. 1 shows a towed submersible vehicle 10 and related support equipment in accordance with the prior art. In this embodiment, the submersible vehicle 10 includes a hull 12 having a streamlined cylindrical body 13. Several fins 14 project radially from the hull 12 as fixed control surfaces. The front (or bow) of the body 13 includes an open aperture 16 covered by a transparent window 18. The body 13 has a substantially enclosed back (or stern) 20 and a tail section 22 which is attached to the back 20 and which has a vertical steering flap 24 and a horizontal steering flap 26. The vertical and horizontal steering flaps 24, 26 are actuated by a pair of actuators (not shown) which are disposed within a payload area 21 inside the body 13. Actuator arms 28 extend through the back 20 of the hull 12 to actuate the vertical and horizontal steering flaps 24, 26.

The hull 12 also includes a tow point 30 located on an upper portion of the body 13 for attaching the submersible vehicle 10 to a tether or tow cable of a surface vessel. A pair of runners 32 are attached to the lower fins 14 to protect the vehicle from striking rocks or other objects on the ocean floor.

Support equipment for the submersible vehicle 10 includes a control unit 34, which is connected to the submersible vehicle 10 by an umbilical 36. Power is delivered to the submersible vehicle 10 through the umbilical 36, and control signals from the controller 34 are transmitted through the umbilical 36 to the actuators for independently actuating the vertical steering flap 24 and the horizontal steering flap 26. In the embodiment shown in FIG. 1, a viewing visor 38 may be connected by the umbilical 36 to a camera located within the payload compartment 21 which transmits photographic images of the underwater scene to the viewing visor 38. A camera control box 40 is electronically coupled to the camera by the umbilical 36, enabling an operator on the surface vessel to adjust the photographic images as desired.

In operation, the submersible vehicle 10 is towed behind a surface vessel over an area of interest, such as a pipeline, potential fishing area, or potential shipwreck area. Wearing the viewing visor 38, the operator uses the controller 34 to control the movement of the submersible vehicle by adjusting the deflections of the vertical and horizontal steering flaps 24, 26. Lateral movement of the submersible vehicle 10 is controlled by deflecting the vertical steering flap 24, causing the vehicle to turn to the right or left (i.e. "yaw"). The depth of the submersible vehicle 10 is controlled by deflecting the horizontal steering flap 26, causing the bow of the vehicle to pitch up or down (i.e. "pitch"). In this way, the operator is able to control the flight of the submersible vehicle 10 over the areas of interest on the ocean floor to perform inspections or acquire desired information.

Although desirable results have been achieved using the prior art system, several characteristics of the submersible vehicle 10 leave room for improvement. For instance, when the vehicle 10 is being towed in a current, especially a current that flows across the direction of travel of the surface vessel, the submersible vehicle 10 may become unstable. Cross-currents tend to cause the submersible vehicle 10 to "roll" about a lengthwise axis so that the runners 32 may no longer remain below the vehicle for protection. The rolling of the submersible vehicle 10 may also interfere with or disable the data acquisition equipment contained within the payload section. Strong currents along the direction of travel of the surface vessel (i.e. along the freestream flow direction) may also hamper the controllability of the vehicle 10.

Also, undesirable rolling characteristics are experienced when the submersible vehicle 10 is guided by the operator to a position that is laterally displaced to the sides of the surface vessel. That is, when the submersible vehicle 10 is flown out widely to the left or to the right of the surface vessel, the tether which is attached to the tow point 30 pulls on the tow point causing the vehicle to roll undesirably.

Furthermore, under some operating conditions, the shape and orientation of the fins 14 and the vertical and horizontal steering flaps 24, 26 fail to provide the desired hydrodynamic stability and controllability of the submersible vehicle 10. In rough seas and high currents, such as those which may be experienced in the fisheries of the North Atlantic and North Pacific Oceans, and in some areas commonly associated with shipwrecks in the southeastern Pacific Ocean, prior art submersible vehicles sometimes fail to provide adequate or required stability or maneuverability characteristics, including roll, pitch, and yaw control.

Another drawback of prior art submersible vehicles 10 is the manner in which various exterior devices are attached to the body 13 of the hull 12. For example, FIG. 9 is an enlarged, partial isometric view of the hull 12 of the submersible vehicle 10 of FIG. 1. As shown in FIG. 9, one of the fins 14 is attached to the body 13 by a plurality of weld points 50, and the tow point 30 is attached to the body 13 by additional weld points 52. Also, a mount 54 for attaching various external equipment (e.g. lights, cameras, instrumentation, etc.) to the hull 12 includes a base member 56 that is attached to the body 13 by a plurality of weld points 51. A threaded aperture 58 is disposed in the base member 56 to enable various external equipment to be mounted to the hull 12. Of course, in other prior art vehicles, the number of weld points 50, 51, 52 may be greater or fewer than that shown in FIG. 9.

The prior art methods of attaching devices to the body 13 of the hull 12 by welding has several drawbacks. For example, the weld points 50, 51, 52 are susceptible to rust, particularly in a seawater environment, and may eventually become weakened. Additionally, the extremely high temperatures involved in the prior art methods of welding the fins 14 and other devices to the body 13 of the hull 12 may result in warpage or other deformities of the local area of the hull 12 proximate to the weld points 50, 51, 52. Such deformities may undesirably degrade the accuracy with which the external equipment is positioned on the hull 12, or may even degrade the strength and integrity of the hull 12, particularly for hulls 12 designed to withstand extreme pressures. Yet another disadvantage of the prior art methods of attachment is that once a device (e.g. a fin 14 or a tow point 30) is welded to the body 13 of the hull 12, it becomes difficult to remove for repairs or re-configuration of the vehicle 10.

SUMMARY OF THE INVENTION

The present invention relates to improved methods and apparatus for hull attachment for submersible apparatus. The inventive attachment apparatus provide improved adjustability, maintainability, integrity, reliability, and overall improved mission performance of submersible apparatus, particularly submersible vehicles. In one embodiment, a submersible apparatus in accordance with the invention includes a hull having an elongated channel. A sliding member is at least partially disposed within the channel and moveable along at least a portion of the channel. A mounting assembly is attached to the sliding member and includes an engagement member coupled to the sliding member, the engagement member being selectively engageable between a first position wherein the mounting assembly is moveable along the channel, and a second position wherein the mounting assembly is secured in a fixed position along the channel. The apparatus advantageously permits a wide variety of equipment or devices (e.g. tow point assemblies, wing assemblies, tail assemblies, propulsion units, illumination devices, imaging devices, instrumentation, sensors, etc.) to be adjustably attached to the hull.

DETAILED DESCRIPTION OF THE INVENTION

The present invention relates to arcuate-winged submersible vehicles for use in, for example, underwater payload delivery and data acquisition, including hydrographic surveys for commercial, ecological, professional, or recreational purposes. Many specific details of certain embodiments of the invention are set forth in the following description and in FIGS. 2–8 and 10–18 to provide a thorough understanding of such embodiments. One skilled in the art, however, will understand that the present invention may have additional embodiments, or that the present invention may be practiced without several of the details described in the following description.

Figure 2:
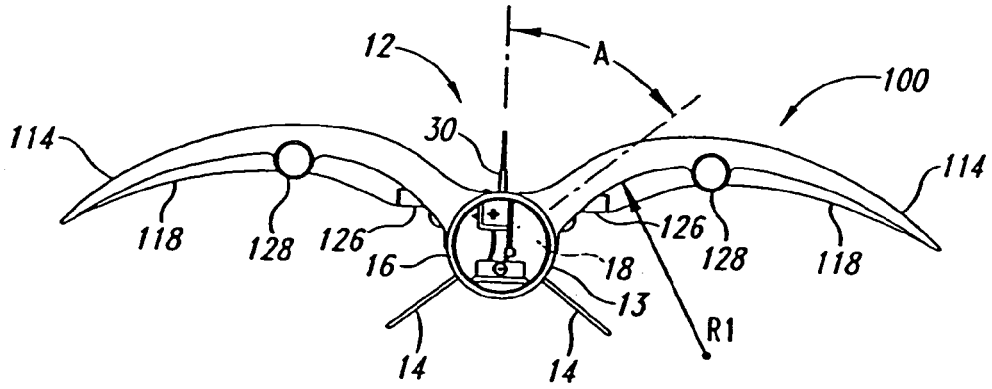
FIG. 2 is a front elevational view of an arcuate-winged submersible vehicle in accordance with an embodiment of the invention.

FIG. 2 shows a front elevational view of an arcuate-winged submersible vehicle 100 in accordance with the present invention. In this embodiment, the vehicle 100 has a hull 12 that includes a cylindrical body 13 and a pair of arcuate (or "gull-shaped") wings 114 projecting outwardly from the body 13 at an angle A with the vertical (see FIG. 2). The arcuate wings 114 may typically attach to the body over a range of angles from about 30 to about 70 degrees, with a value of A of approximately 50 degrees being preferred. Each arcuate wing 114 has a partially curved or arcuate shape with a lateral radius of curvature R1 that varies from the wing root 122 to the wing tip 120. In this embodiment, the lateral radius of curvature R1 of the arcuate wings 114 increases with increasing distance from the body 13 and is greater near the leading edges 116 or bow of the vehicle 100 and less along the trailing edges 118 of the wings. A pair of straight planar fins 14 project downwardly and radially outward from the body 13. The body 13 has an aperture 16 at the bow covered by a transparent window 18 (see FIG. 3), a watertight, enclosed back 20, and an interior payload compartment 21. The hull 12 also has a tow point 30 attached along a top portion of the body 13. A light fixture 128 is attached to a lower surface of each wing 114.

Figure 3:
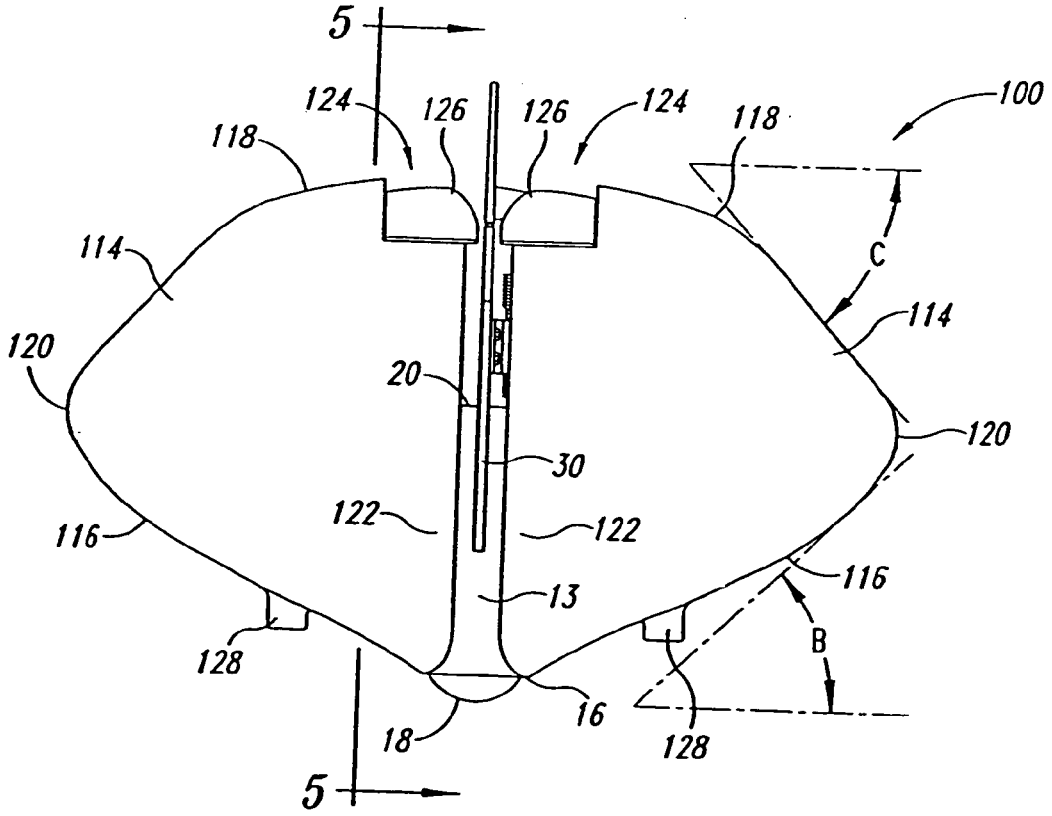
FIG. 3 is a top elevational view of the arcuate-winged submersible vehicle of FIG. 2.

FIG. 3 is a top elevational view (or "planform" view) of the arcuate-winged submersible vehicle 100 showing additional features of the arcuate wings 114. In this embodiment, each arcuate wing 114 has a leading edge 116 that is swept in a rearward direction. In other words, the leading edges 116 do not project from the body 13 in a perpendicular direction, but rather, are angled toward the rear of the vehicle at an angle B which varies with distance from the body 13. The light fixture 128 projects slightly ahead of the leading edge 116 of each arcuate wing 114.

As further shown in FIG. 3, each arcuate wing 114 also has a trailing edge 118 that is swept in a forward direction at an angle C which also varies with distance from the body 13. The leading and trailing edges 116, 118 of the arcuate wings 114 join together at a smoothly curved wing tip 120. Each arcuate wing 114 also has a wing root 122 attached to the body 13. The trailing edge 118 of each arcuate wing 114 is further shaped to define a cutout area 124, and a wing steering flap 126 is hingeably attached to each arcuate wing 114 and received within the cutout area 124. Each wing steering flap 126 is adjustably deflectable over a range of positions from a full-up position to a full-down position.

In the embodiment shown in FIG. 3, the angle B of the swept leading edge 116 averages about 32 degrees along an inner section near the body, decreases to an average of about 27 degrees along a middle section of the leading edge 116, increases again to an average of about 45 degrees along an outer section, and then continues to increase to 90 degrees at the wing tip 120 to smoothly join with the trailing edge 118. Similarly, the angle C of the swept trailing edge 118 varies from an average of about zero degrees along an inner section near the body, increases to an average of about 47 degrees along a middle section of the trailing edge 118, and then continues to increase to 90 degrees at the wing tip 120. It should be understood, however, that the variation of the angles B and C of the leading and trailing edges 116, 118 respectively, may be varied from the particular embodiment shown to any number of possible configurations depending upon the intended maneuverability characteristics or the desired appearance of the vehicle, including, for example, holding angles B and C constant.

Figure 4:
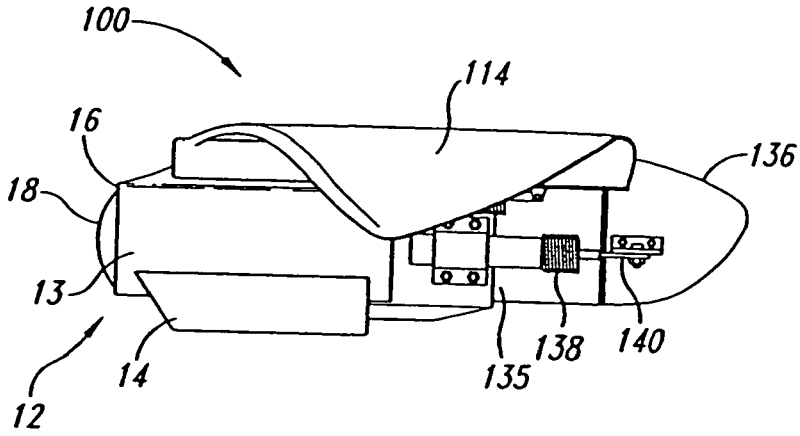
FIG. 4 is a side elevational view of the arcuate-winged submersible vehicle of FIG. 2.
Figure 5:
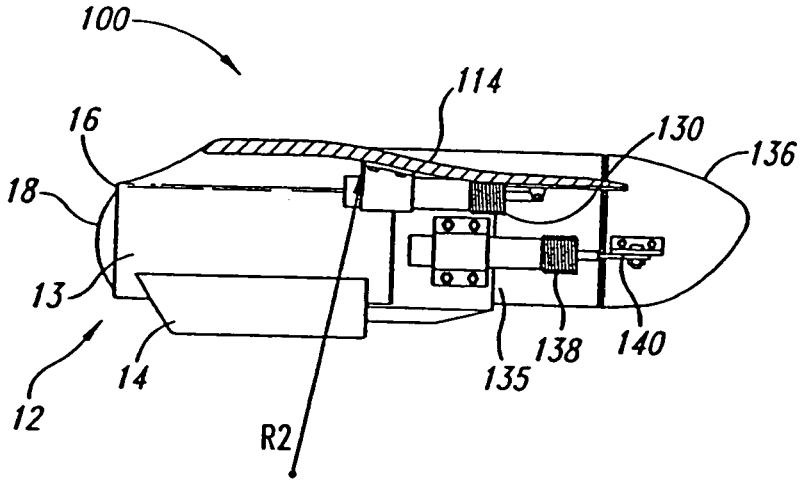
FIG. 5 is a partial cross-sectional view of the arcuate-winged submersible vehicle taken along line 5—5 of FIG. 3.

FIG. 4 is a side elevational view of the arcuate-winged submersible vehicle 100, and FIG. 5 is a partial cross-sectional view of the vehicle 100 taken along line 5—5 of FIG. 3. As shown in FIG. 5, the arcuate wings 114 has a cross-sectional shape 115 that has a longitudinal radius of curvature R2. In this embodiment, the longitudinal radius of curvature R2 is approximately infinite near the leading edge 116 and the trailing edge 118 of the cross-sectional shape 115 (i.e. the wing is substantially planar near the leading and trailing edges 116, 118). Along an intermediate portion, the cross-sectional shape 115 has a positive longitudinal radius of curvature R2, followed by a negative longitudinal radius of curvature R2 and the cross-sectional shape 115 becomes planar near the trailing edge 118.

Because the arcuate-winged vehicle 100 has an approximately planar portion (i.e. approximately infinite lateral and longitudinal radii of curvature R1, R2) in the vicinity of the cutout areas 124 of the trailing edges 118, the wing steering flaps 126 are substantially planar. This configuration preferably enables the wing steering flaps 126 to be hingeably attached to the arcuate wings 114 in a conventional straight-hinge fashion to reduce turbulence and cavitation for improved wing steering flap performance.

Alternately, the lateral radius of curvature R1 in the vicinity of the cutout areas 124 may be finite (i.e. curved), and the wing steering flaps 126 may be contoured to the shape of the arcuate wings 114 and joined to the wings in a less conventional manner. This may be accomplished, for example, by dividing each wing steering flap 126 into multiple segments (not shown) with each segment being individually hingeably attached to the arcuate wing 114.

Numerous other features of the arcuate wings 114 may be varied from their particular configuration shown in FIGS. 2 through 5. As mentioned above, the variation of the angles B and C of the leading and trailing edges 116, 118 respectively, may be varied from the particular embodiment shown. Alternately, the leading edges 116 may be forwardly swept, or the trailing edges 118 may be rearwardly swept, or the leading and trailing edges 116, 118 may project perpendicularly from the body 13. Furthermore, the lateral and longitudinal radii of curvature R1, R2 of the arcuate wings 114 may be varied from the curvatures shown in the accompanying figures, including, for example, holding these parameters constant.

Figure 6:
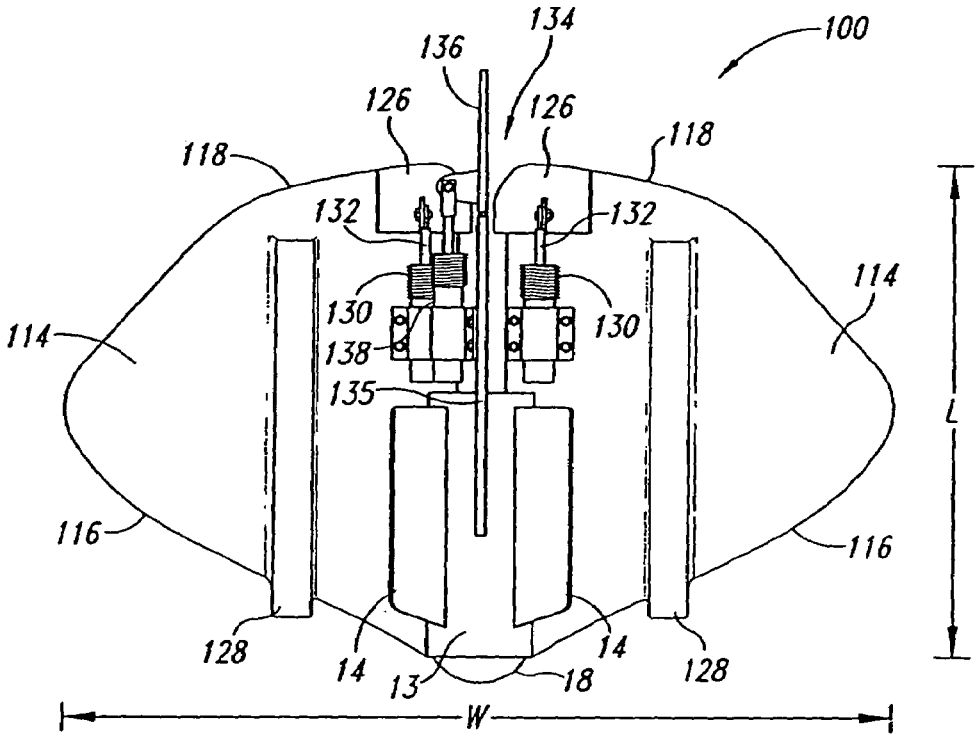
FIG. 6 is a bottom elevational view of the arcuate-winged submersible vehicle of FIG. 2.

FIG. 6 is a bottom elevational view of the arcuate-winged submersible vehicle 100 showing a wing flap actuator 130 attached to the lower surface of each arcuate wing 114. An actuator arm 132 extends from each actuator 130 to each wing steering flap 126 for actuating the wing steering flap 126 between the full-up and full-down positions, thereby providing depth control of the vehicle. The actuators 130 may be of any conventional type, including hydraulic or electrically-driven actuators, such as the Digit linear actuator available from Ultra Motion of Mattituck, N.Y.

The hull 12 also includes a tail assembly 134 having a rigid support 135 extending from the back 20 of the body 13. A vertical tail steering flap 136 is hingedly attached to the rigid support 135 and is hingeably and adjustably deflectable over a range of positions from a full-left position to a full-right position. As best seen in the side elevational view of the vehicle 100 shown in FIG. 4, a tail flap actuator 138 is attached to the rigid support 135. A control arm 140 attaches the tail flap actuator 138 to the tail steering flap 136 for actuating the tail steering flap 136 between the full-left and full-right positions, thereby providing lateral or yaw control of the vehicle.

One may note that a wide variety of control surface configurations may be utilized to control the vehicle 100. The wing steering flaps 126, for example, may be joined by an appropriate linkage to operate in unison so that only one wing flap actuator is needed to actuate both wing flaps to provide pitch control, although some controllability of the vehicle (e.g. roll control) may be sacrificed. Also, the wing flaps need not be disposed within cutout areas 124, and may be repositioned anywhere along the trailing edges of the wings. The wing flaps may even be eliminated and replaced by one or more control surfaces located elsewhere on the vehicle, including those which project from the tail assembly 134 (e.g. "elevators"), or from the body 13 (e.g. "canards"), or from other portions of the hull 12.

Similarly, the vertical tail steering flap 136 may be repositioned on the hull of the vehicle, or may be eliminated and replaced with suitable control surfaces that provide the desired lateral (or "yaw") directional control, including pairs of vertical control surfaces mounted on the wings or elsewhere on the vehicle. Furthermore, the vehicle may be controlled by replacing the wing flaps and the tail flap with a "V-tail" having two deflectable control surfaces that provide the desired pitch, yaw, and roll control. A non-exhaustive collection of possible control surface configurations suitable for use with arcuate-winged vehicles is presented by Professor K. D. Wood's "Aerospace Vehicle Design, Volume I," Second Edition, at pages 1–9:22 through 1–9:23, published by Johnson Publishing Company of Boulder, Colo., incorporated herein by reference.

Figure 1:
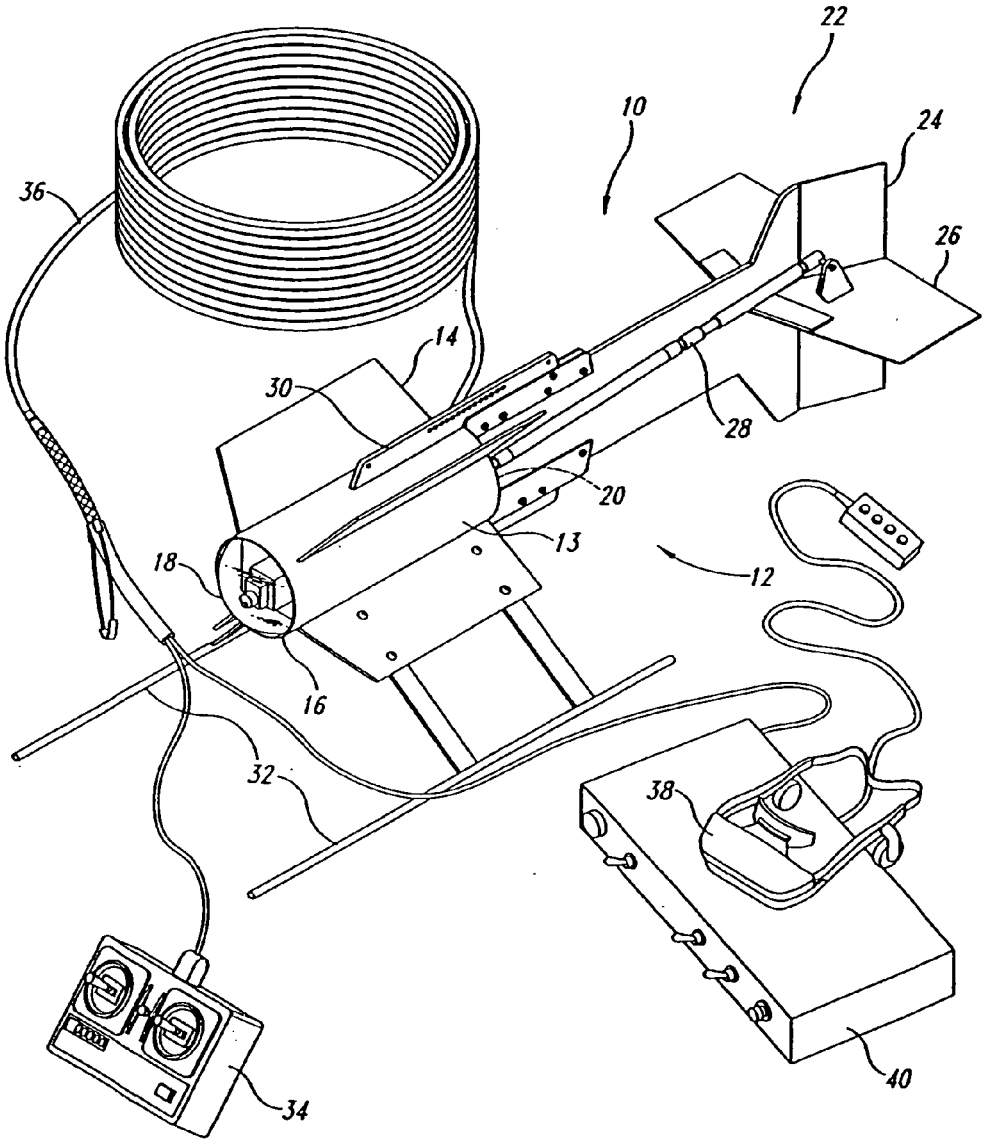
Fig. 1 (Prior Art)
FIG. 1 is an isometric view of a towed submersible vehicle and related support equipment in accordance with the prior art.
Figure 7:
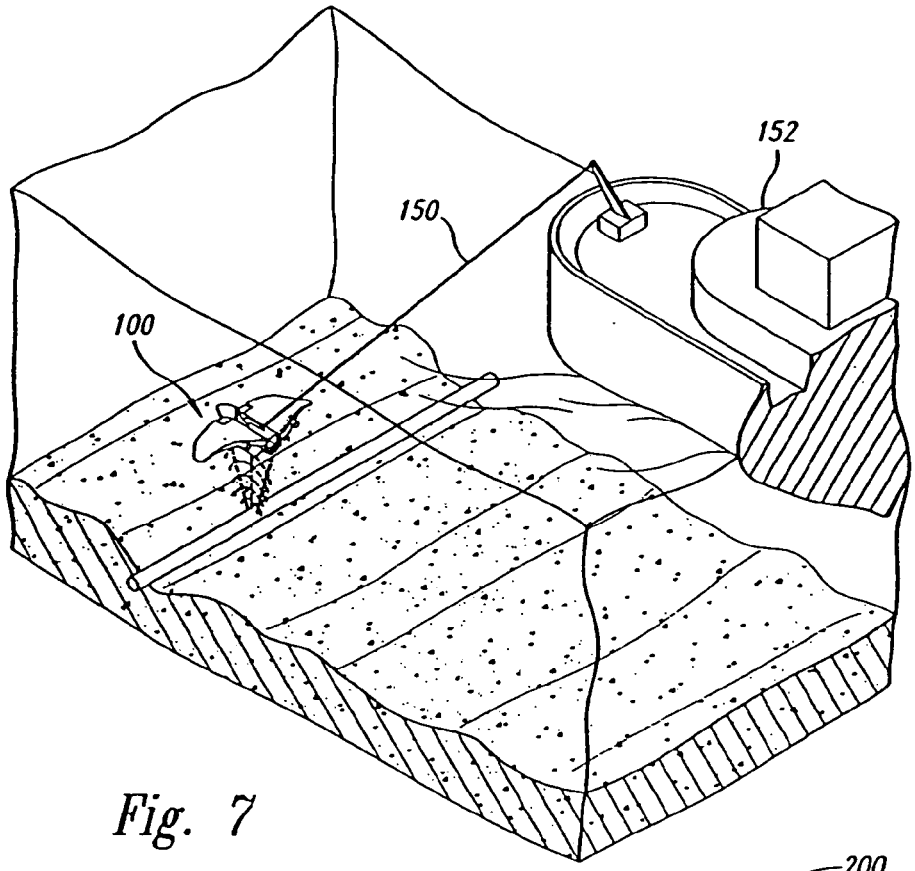
FIG. 7 is an isometric view of the arcuate-winged submersible vehicle of FIG. 2 being towed by a surface vessel.

FIG. 7 is an isometric view of the arcuate-winged submersible vehicle 100 being towed behind a surface vessel 152 using a tether 150. As the vehicle 100 is towed through a fluid medium, the arcuate wings 114 enhance the stability and controllability of the vehicle's movement through the medium. An operator or controller (not shown) on the surface vessel 152 may control the flight of the vehicle 100 by transmitting control signals from a control unit to the wing and tail flap actuators 130, 138. The control signals may be electrically transmitted from the control unit via an umbilical (FIG. 1), or by an RF signal sent by a transmitting antenna, or even by acoustic signals. The operator transmits appropriate control signals to the wing flap and tail flap actuators 130, 136 to deflect the wing steering flaps 126 and tail steering flap 136, thereby controlling the depth and lateral position of the vehicle with respect to the direction of travel of the surface vessel. In this manner, the operator pilots the arcuate-winged submersible vehicle 100 over a desired flight path.

The operator may receive visual images or other feedback signals from a camera or other navigational equipment (e.g. inclinometer, depth gauge, sonar, etc.) on board the vehicle to assist in operating the vehicle. In addition, a computer, microcomputer, or other programmable device may be located on-board the vehicle, such as within the payload compartment, to monitor input signals from the controller or from the navigational sensors and to transmit appropriate feedback signals to the controller on the surface vessel 152, or control signals to the actuators 130, 138 to control wing steering flap deflections and tail steering flap deflections, respectively. The on-board computer or control system might therefore be used, for example, as a safety system to prevent the vehicle from exceeding a maximum depth, to maintain the attitude of the vehicle, or to prevent collisions with submerged structures.

The arcuate-winged submersible vehicle 100 provides markedly improved stability and maneuverability over prior art submersible vehicles having straight wings or simple fins. The arcuate-shaped wings 114 increase the operator's control over the vehicle, improving the ability to fly the vehicle along a desired path over the floor of the ocean, especially when the vehicle is guided a great distance to the left or right of the surface vessel 152. Undesirable rolling characteristics exhibited by prior art vehicles are substantially reduced or eliminated. Similarly, the stability and maneuverability of the arcuate-winged vehicle in a strong cross-current is favorably improved over the characteristics of prior art submersible vehicles.

The improved hydrodynamic maneuverability and stability of the submersible arcuate-winged vehicle 100 provides superior payload delivery and data acquisition characteristics over prior art submersible vehicles. Because the vehicle is more stable, data acquired from a variety of payload devices (cameras, sonar, microphones, etc.) are of better quality than obtained using prior art submersible vehicles. Therefore, the arcuate-winged submersible vehicle 100 provides improved hydrographic survey data for such applications as marine bio-mass surveys in fisheries, ecological surveys, underwater mapping surveys or mineral exploration or searching for shipwrecks, and many other applications.

As described above, the shape of the arcuate-winged vehicle 100 may differ from that shown in the figures. Tests suggest, however, that the shape having the swept leading and trailing edges 114, 116 as shown in the accompanying figures provides desirable vehicle stability and maneuverability characteristics. In particular, for a wingspan w defined as the distance from wing tip to wing tip of the arcuate wings 114 (see FIG. 6), and a distance L is defined as the maximum distance from the leading edge to the trailing edge of the arcuate wings 114, optimum characteristics have been achieved where the ratio w/L is approximately equal to 3/2.

It should also be understood that the arcuate wings 114 may project from the hull 12 from any number of positions about the circumference of the body 13. For example, the arcuate wings may attach to the body 13 at higher or lower positions than those shown in FIG. 2. Desirable results have been achieved, however, with the configuration shown in FIG. 2 where the curvature of the arcuate wings 114 is such that the wing tips 120 are at approximately the same "water line" (i.e., same vertical level) as the attachment point between the wing root 122 and the body 13.

Figure 8:
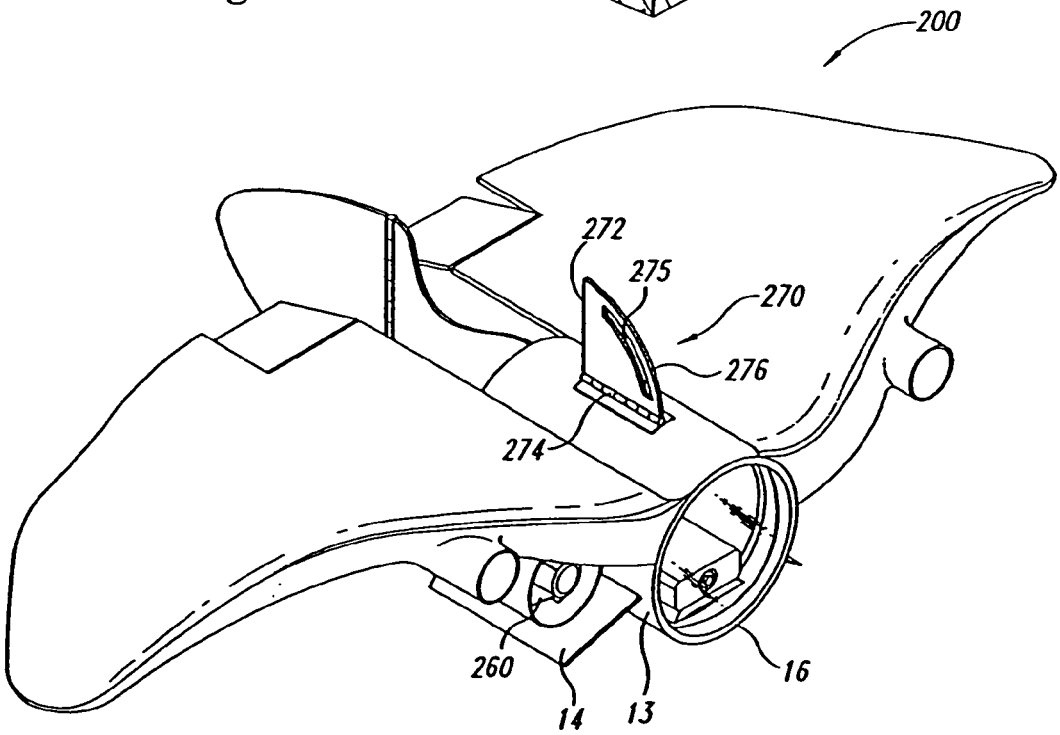
FIG. 8 is an isometric view of an alternate embodiment of an arcuate-winged submersible vehicle in accordance with the invention.

FIG. 8 shows an arcuate-winged submersible vehicle 200 in accordance with an alternate embodiment of the invention. In this embodiment, the arcuate-winged submersible vehicle 200 includes a propulsion unit 260 attached to each fin 14. The propulsion units 260 are of any conventional type, including electrical or hydraulic units, and advantageously enable the vehicle 200 to be propelled along a desired path without being towed by a surface vessel. As the vehicle 200 propels itself through the fluid medium, the arcuate wings enhance the stability and controllability of the vehicle's movement through the medium. The desired stability and maneuverability characteristics are thereby achieved in an autonomously powered vehicle 200. Although the arcuate-winged vehicle 200 may remain tethered to a surface vessel for purposes of recovery or launch of the vehicle 200, or for transmittal of control signals to the control actuators, the vehicle 200 is otherwise free to maneuver independently from the surface vessel.

The arcuate-winged vehicle 200 further includes a hingable tow point assembly 270. The tow point assembly 270 has a tow plate 272 coupled to the body 13 of the hull 12 by a hinge 274. The tow plate 272 includes an arcuate slot 274 disposed therethrough and positioned proximate to an arcuate leading edge 276 of the tow plate 272. The arcuate slot 274 is sized to receive a shackle (not shown) of a tow cable or tether for launch or recovery of the vehicle. The tow point assembly 270 is especially useful, however, on towed vehicle configurations such as the vehicle 100 shown in FIGS. 2 through 7.

In operation, the tow plate 272 of the hingable tow point assembly 270 is pivotably movable with respect to the body 13 about the hinge 274. The tow plate 272 adjustably pivots over a range of positions from a full left position contacting one arcuate wing 114 to a full right position contacting the other arcuate wing 114. Therefore, as an operator controls the tail steering flap deflection to guide the vehicle laterally to the side of the surface vessel, the tow plate 272 pivots about the hinge 274, and undesirable rolling of the vehicle 200 caused by the tow cable is reduced or eliminated. Similarly, as the operator adjusts the wing steering flap deflection to cause the vehicle to dive to greater depths, the shackle of the tow cable slides within the arcuate slot 274. In this way, undesirable nose up or nose down pitching of the vehicle caused by the tow cable is reduced or eliminated.

Several features of the tow point assembly 270 may be varied from the embodiment shown in FIG. 8. The size and shape of the tow plate 272, for example, may be modified to a wide variety of suitable sizes and shapes. Similarly, the length and shape of the arcuate slot 274 may be varied as desired, including quarter-circular, semi-circular, elliptic, and parabolic shapes. The most suitable geometry of the tow point assembly for a particular submersible vehicle may depend on a number of factors, including the anticipated flight path of the vehicle. Although the tow point assembly 270 is shown in FIG. 8 on an arcuate-winged vehicle 200, it is also suitable for use with a wide variety of towed or autonomously powered conventional submersible vehicles that do not have arcuate wings.

Figure 10:
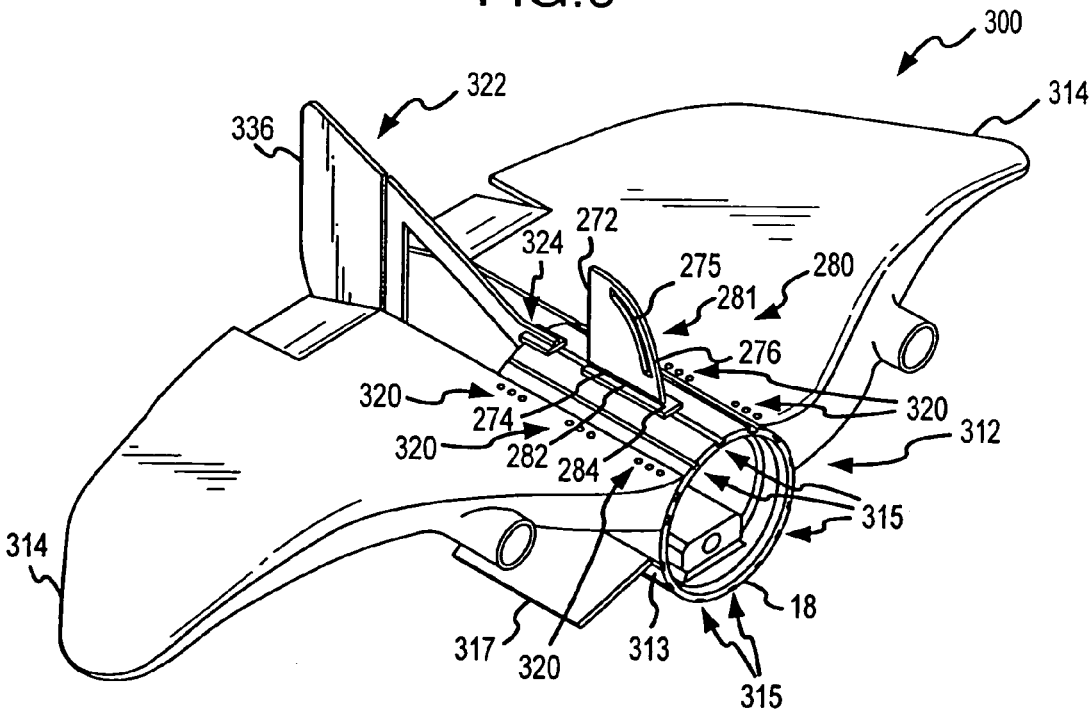
FIG. 10 is an isometric view of a submersible vehicle in accordance with another embodiment of the invention.
Figure 11:
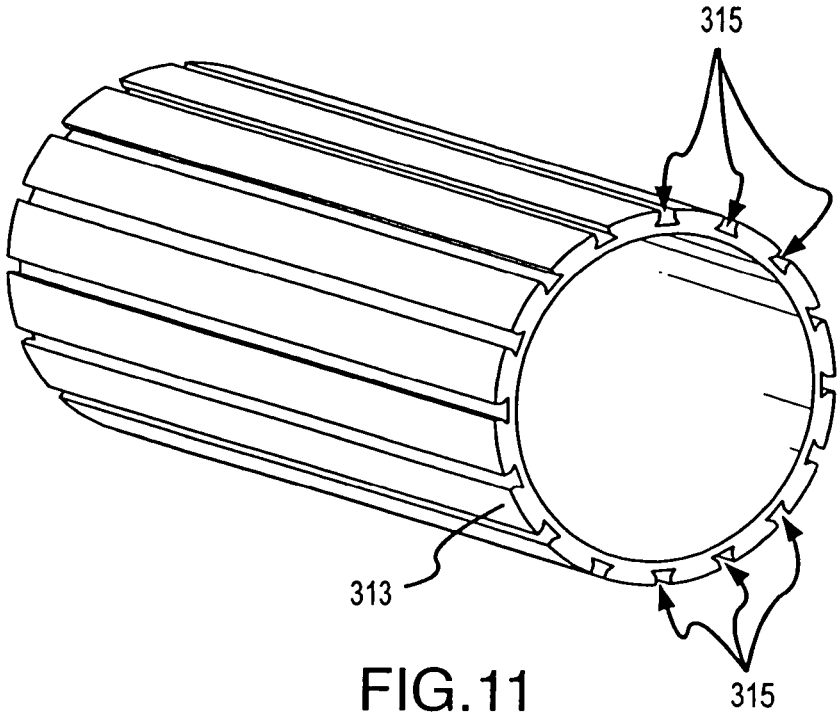
FIG. 11 is an enlarged isometric view of the body portion of the hull of the submersible vehicle of FIG. 10.

FIG. 10 is an isometric view of a submersible vehicle 300 in accordance with another embodiment of the invention. In this embodiment, the vehicle 300 includes a hull 312 having a body 313 with a plurality of longitudinal channels 315 disposed therein. As best shown in FIG. 11, the plurality of channels 315 are disposed within the outer surface of the body 313 at a plurality of circumferential positions, and in this embodiment, extend longitudinally along the entire length of the body 313. The channels 315 may be formed in the body 313 in any conventional manner, including machining or casting.

Referring again to FIG. 10, a pair of arcuate wings 314 are attached to the body 313 by a plurality of wing attachment assemblies 320. Similarly, a tail assembly 322 is attached to the body 313 by a tail attachment assembly 324, and a tow point assembly 280 is attached to the body 313 by a tow point attachment assembly 281.

Figure 12:
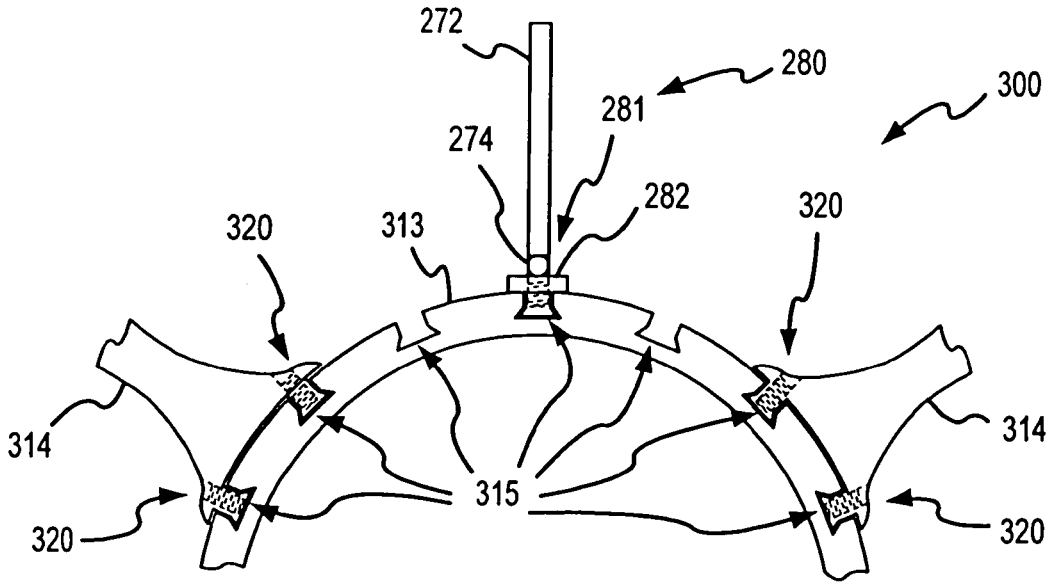
FIG. 12 is an enlarged, partial front elevational view of the submersible vehicle of FIG. 10.

FIG. 12 is an enlarged, partial front elevational view of the submersible vehicle 300 of FIG. 10. As shown in FIG. 12, in this embodiment, each arcuate wing 314 is attached to the body 313 by wing attachment assemblies 320 along two of the longitudinal channels 315. Similarly, the tow point assembly 280 and the tail assembly 322 (FIG. 10) are attached to the body 313 along a single longitudinal channel 315 extending along the top of the body 313 by respective tow point and tail attachment assemblies 281, 324. As described more fully below, the wing, tail, and tow point attachment assemblies 320, 322, 281 are adjustably positionable along their corresponding longitudinal channels 315.

Figure 13:
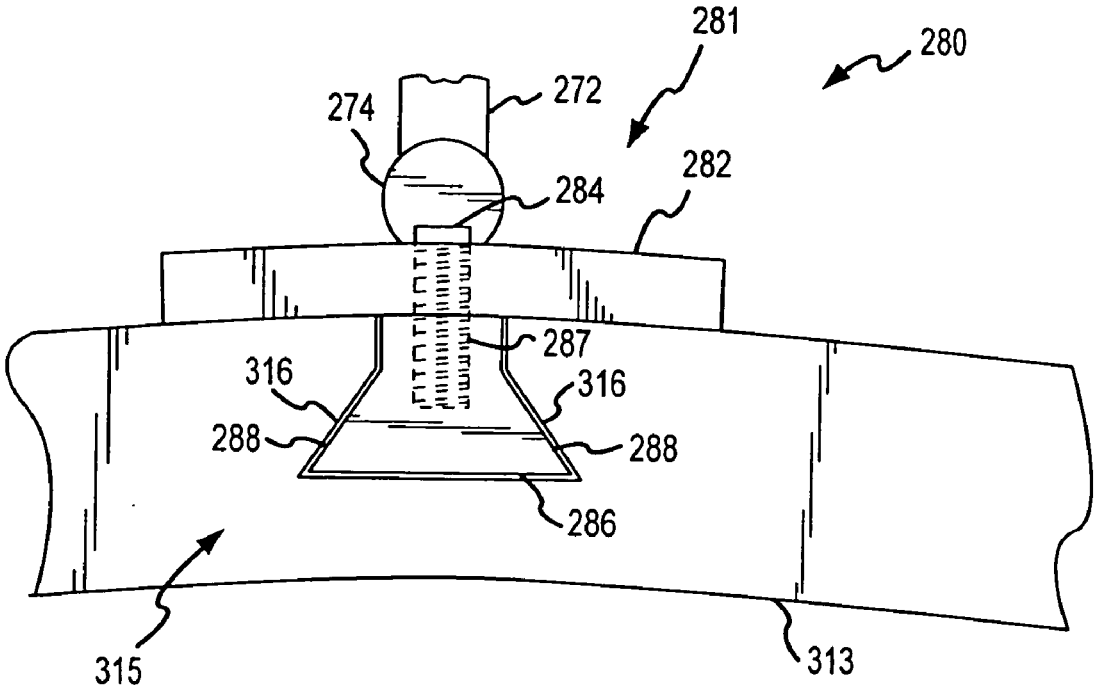
FIG. 13 is an enlarged, partial front elevational view of the tow point attachment assembly of FIG. 12.
Figure 14:
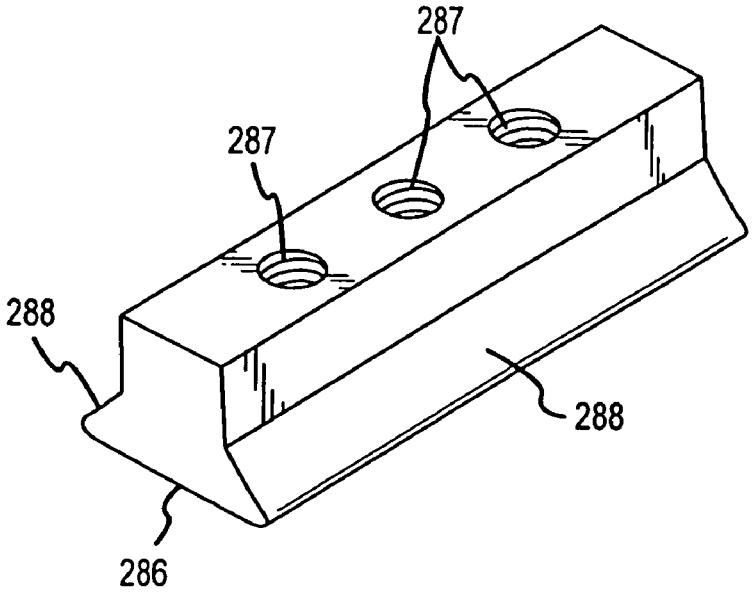
FIG. 14 is an enlarged isometric view of a rail nut of the tow point assembly of FIG. 13.

FIG. 13 is an enlarged, partial front elevational view of the tow point attachment assembly 281 of FIG. 12. In this embodiment, the tow point attachment assembly 281 includes a base 282 having a threaded member 284 disposed therethrough. A rail nut 286 is slideably positioned within the channel 315 and includes an engagement hole 287 threadedly engaged with the threaded member 284. As shown in FIG. 14, in this embodiment, the rail nut 286 has three threaded engagement holes 287 disposed therein, allowing for up to three threaded members 284 to be used. As the threaded member 284 is tightened, engagement surfaces 288 on the rail nut 286 are brought into engagement with opposing locking surfaces 316 of the channel 315 to secure the rail nut 286, and thus the tow point attachment assembly 281, in position in the channel 315.

The tow point attachment assembly 281 advantageously permits the tow point assembly 280 to be moved axially along the length of the submersible vehicle 300 by simply loosening the one or more threaded members 284, sliding the rail nut 286 axially along the channel 315, and re-tightening the threaded members 284. Thus, the tow point assembly 280 may be easily re-positioned to account for variations in the center of gravity of the submersible vehicle 300. For example, if various external equipment (e.g. lights, cameras, instrumentation, etc.) are attached to or removed from the hull 312, the position of the tow point assembly 280 may be adjusted along the channel 315 to maintain the desired pitch and trim characteristics of the vehicle 300. Because the axial position of the tow point attachment assembly 281 is adjustable by simply loosening and tightening one or more threaded members, the position of the tow point assembly 280 may be adjusted more easily and quickly than prior art assemblies, especially those that rely on weldments or other methods of fixing the assembly to the hull.

Another advantage of the inventive attachment assembly 281 is that, in the event repairs are needed, the tow point assembly 280 may be easily detached and replaced with spare parts. This advantageously improves the maintainability of the vehicle, and also reduces or eliminates down time of the vehicle 300.

Figure 9:
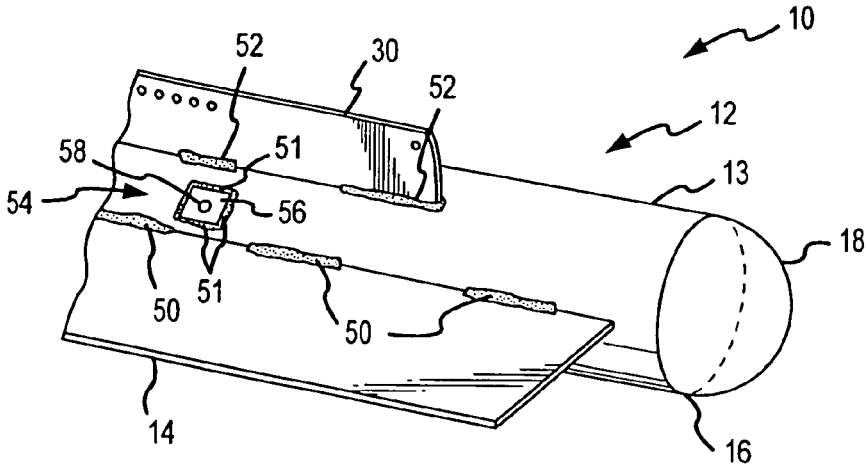
(PRIOR ART) FIG.9
FIG. 9 is an enlarged, partial isometric view of the hull of the prior art submersible vehicle of FIG. 1.

Yet another advantage of the inventive attachment assembly 281 is that welds 52 (FIG. 9) to the surface of the body of the hull may be eliminated. Because welds 52 may be susceptible to rust and may become weakened, the inventive attachment assembly 281 may exhibit longer life and greater reliability than prior art methods that rely on weldments. Also, by eliminating the extremely high temperatures associated with welding, certain undesirable side effects of the welding process (e.g. warpage or other deformities of the hull) may be eliminated that further improve the strength, structural integrity, reliability, and useable life of the vehicle. Furthermore, the inventive attachment assemblies may provide improved control and accuracy of the position of the attached device, such as the tow point assembly 280.

Similarly, the tail attachment assembly 324 may be constructed in the same manner as the tow point attachment assembly 281 shown in FIGS. 12–14. Thus, the above-noted advantages of improved adjustability, maintainability, integrity, and overall performance may also be realized using the inventive attachment scheme for the tail assembly 322. Furthermore, the tail assembly 322 may be moved fore and aft on the body 313 as necessary to modify the characteristics of the vehicle, including, for example, the location of the center of gravity, or the moment arm of the tail flap 336. To provide the desired strength and rigidity, in a preferred embodiment, the tail assembly 322 is mounted to the body 313 by a pair of tail attachment assemblies 324 (only one visible in FIG. 10) attached to the opposing uppermost and lowermost channels 315 of the body 313.

It may be noted that the inventive attachment assemblies 281, 324 may be used to attach virtually any external device to the body 313, including, for example, the fins 317, or cameras, lights, instrumentation, or any other equipment. Furthermore, the inventive attachment assemblies are not limited to use with arcuate winged submersible vehicles, but rather, may be employed on all manner of existing submersible vehicles (e.g. FIG. 1), surface vessels, or on any type of apparatus wherein the above-noted advantages of improved position adjustability, maintainability, and integrity may be desired, including submersible tanks, sealable vessels, boat hulls, or other suitable apparatus.

Figure 15:
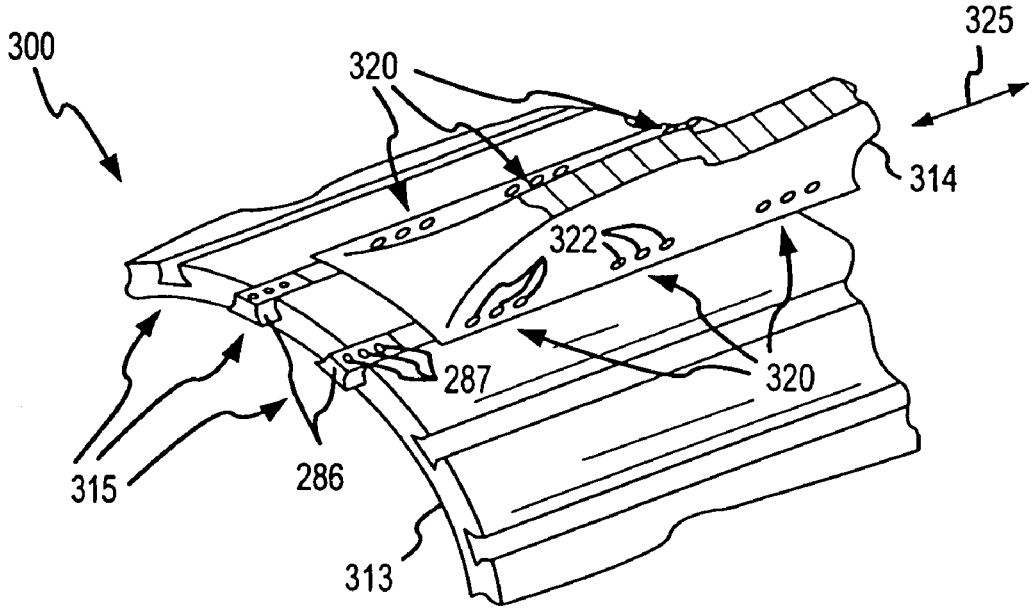
FIG. 15 is an enlarged, partial isometric exploded view of a wing attachment assembly of the submersible vehicle of FIG. 10.

FIG. 15 is an enlarged, partial isometric exploded view of the wing attachment assemblies 320 of the submersible vehicle 300 of FIG. 10. As shown in FIG. 15, in this embodiment, the wing 314 is attached to the body 313 of the hull 312 by a plurality (in this case six) wing attachment assemblies 320. Each wing attachment assembly 320 includes a plurality of holes 322 extending through the base of the wing 314 that are aligned with corresponding threaded engagement holes 287 in corresponding rail nuts 286 (only two visible in FIG. 15) disposed in channels 315 of the body 313. Although the two rail nuts 286 shown in FIG. 15 are shown for illustrative purposes as extending beyond the end of the body 313, and as discussed above, they may be positioned anywhere along the length of their respective channels 315. A threaded member 284 (FIG. 13) extends through each hole 322 and is threadedly engaged with the corresponding engagement hole 287, thereby securing the wing 314 to the body 313.

The inventive wing attachment assemblies 320 provide the above-noted advantages of improved adjustability, maintainability, integrity, and overall performance for attachment of the wings 314 to the body 313. Also, the inventive attachment assembly enables the wings 314 to be moved fore and aft on the body 313 (denoted by arrow 325 in FIG. 15) as necessary to modify the hydrodynamic characteristics of the vehicle, including, for example, the location of the center of gravity, the location of the center of lift of the wings, or the moment arm of the wing flaps.

It should be noted that the many of the particular characteristics of the inventive attachment assemblies shown in FIGS. 10–15 may be varied from the embodiments depicted therein. For example, the particular cross-sectional shapes of the channels 315 and the rail nuts 286 may be changed to any shape that provides suitable surfaces that engage and secure the position of the corresponding attachment assembly, including rectangular, partial-circular, or other suitable shapes. Similarly, the size of the rail nut 286 may be increased or decreased as desired, or the plurality of rail nuts may be replaced by a single, elongated rail nut.

Figure 16:
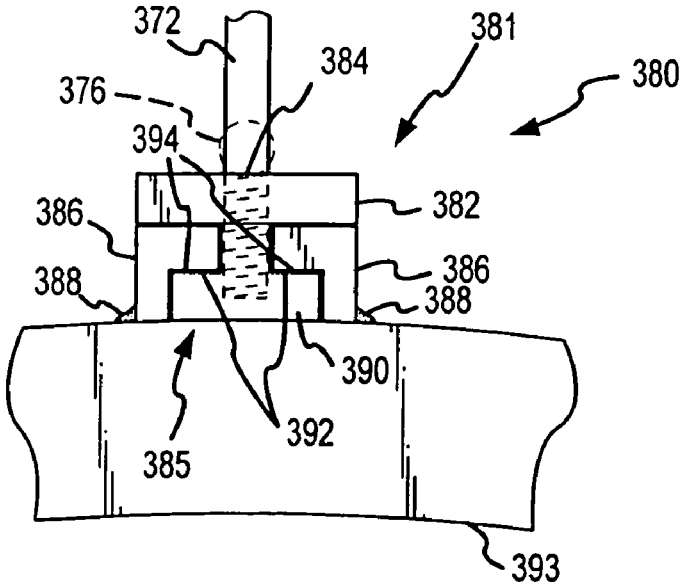
FIG. 16 is an enlarged, partial front elevational view of a tow point attachment assembly in accordance with an alternate embodiment of the invention.

For example, FIG. 16 shows an enlarged, partial front elevational view of a tow point attachment assembly 380 in accordance with an alternate embodiment of the invention. In this embodiment, the tow point assembly 380 includes an attachment assembly 381 that includes a base 382 having a threaded member 384 disposed therethrough. A channel 385 is formed on a body 393 by a pair of angle members 386 that are secured to the body 393 by any suitable method. In the embodiment shown in FIG. 16, the angle members 386 are secured by welds 388 to the body 393. A sliding member 390 is slideably positioned within the channel 385, and is threadedly engaged with the threaded member 384. As the threaded member 384 is tightened, engagement surfaces 392 on the sliding member 390 frictionally engage with locking surfaces 394 on the angle members 386, securing the attachment assembly 381 in position. In alternate embodiments, the wings, tail assembly, or any other external devices may be attached to the.

The attachment assembly 381 shown in FIG. 16 may advantageously provide the above-noted advantages of improved positionability and improved repairability of the tow point assembly through minor modification of the body of the hull. For example, for existing submersible vehicles wherein it may be impractical to replace the existing hull with a hull having channels integrally formed therein (e.g. by machining or casting), some of the beneficial characteristics of the inventive attachment assemblies may be achieved by attaching external members onto the existing hull to form a channel for a sliding member. Clearly, this method of attachment is not limited to the tow point assembly 380 shown in FIG. 16, and may be readily extended to the attachment of the wings, tail assembly, fins, or any other external devices (e.g. lights, cameras, instrumentation, etc.).

Figure 17:
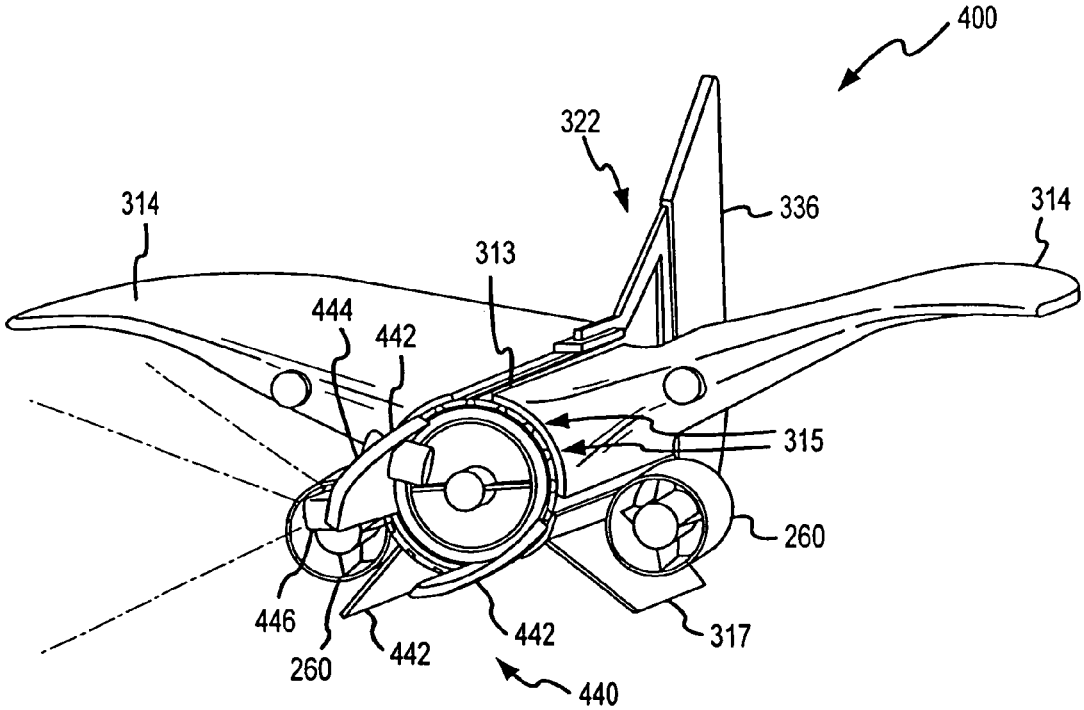
FIG. 17 is an isometric view of a submersible vehicle in accordance with yet another embodiment of the invention.

FIG. 17 is an isometric view of a submersible vehicle 400 in accordance with yet another embodiment of the invention. In this embodiment, the vehicle 400 includes a hull 412 having a body 313 with a plurality of channels 315, and a forward payload assembly 440. A pair of propulsion units 260 are attached to the body 313 by corresponding attachment assemblies of the type described above (with reference to the assemblies 281, 320, 324, and 381). The forward payload assembly 440 includes a plurality of support members 442 that project forward of the body 313 and are slideably attached to the channels 315 at various circumferential stations of the body 313. To improve clarity, only three support members 442 are shown in FIG. 17. In a preferred embodiment, support members 442 are symmetrically attached around the entire circumference of the body 313 to provide improved balance and hydrodynamic characteristics.

Each support member 442 is attached to the body 313 by an attachment assembly that includes a threaded member 284 (FIG. 13) engaged through a hole disposed though the support member 442, and extending into a sliding member 286 (FIG. 15) that is slideably engaged within a channel 315 of the body 313. The sliding members 286 may project out of the channel 315 beyond the front of the body 313, as depicted in FIG. 15. The forward payload assembly 440 may be equipped with any desired instrumentation or payload, including, for example, an illumination device 444, an imaging device 446 (e.g. camera, video, sonar, or radar apparatus), a microphone, or other desired monitors, sensors, and equipment.

As shown in FIG. 17, the body 313 that includes channels 315 (or channels 385 shown in FIG. 16) advantageously permits the submersible vehicle 400 to be easily and economically retrofitted with the forward payload assembly 440. Because the supports 442 may be easily installed or removed from the body 313, the submersible vehicle may be quickly modified to accomplish a variety of missions. For example, the submersible vehicle may be equipped with the forward payload assembly 440 to include sidewardly-viewing instrumentation for inspecting ship hulls, piers, bridge supports, etc., or may be rapidly modified to include downwardly-viewing instrumentation for inspecting the ocean floor, pipelines, communication lines, etc. Alternately, the forward payload assembly 440 may be easily removed to return the submersible vehicle to a substantially forward-looking configuration. Thus, the vehicle having a body with channels further improves the flexibility, versatility, usefulness, and overall mission performance of the submersible vehicle.

Figure 18:
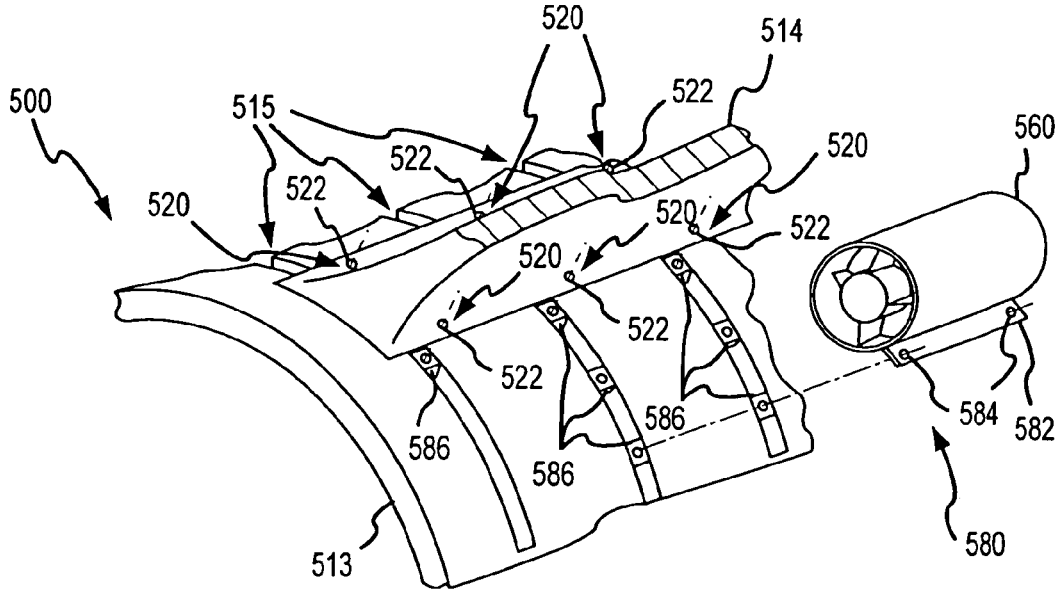
FIG. 18 is an enlarged, partial isometric exploded view of a wing attachment assembly and an equipment attachment assembly of a submersible vehicle in accordance with another alternate embodiment of the invention.

It should be noted that the inventive attachment methods may be employed with circumferential channels, or with channels extending in any other direction on the body of the hull. For example, FIG. 18 is an enlarged, partial isometric exploded view of a wing attachment assembly 520 and an equipment attachment assembly 580 of a submersible vehicle 500 in accordance with another alternate embodiment of the invention. In this embodiment, the vehicle 500 includes a body 513 having a plurality of circumferential channels 515. In FIG. 18, the channels 515 extend partially around the circumference of the body 513. Alternately, the channels 515 may extend entirely around the body 513.

In this embodiment, the wing 514 is attached to the body 513 by a plurality of wing attachment assemblies 520. Each wing attachment assembly 520 includes a threaded member 284 disposed through a hole 522 in the wing 514 and engaged into a sliding member 586 slideably positioned in one of the channels 515. Similarly, the equipment attachment assembly 580 includes a base 582 attached to a plurality of sliding members 586 by a corresponding threaded members 284 (FIG. 13) that are engaged through holes 584.

The submersible vehicle 500 having the body 513 with circumferential channels 515 advantageously improves the adjustability of the positions of the wings and various external equipment around the circumference of the body 513. Thus, the above-noted advantages of improved adjustability, maintainability, integrity, and overall performance for attachment of the wings 514 at various circumferential positions on the body 513. Also, the equipment attachment assembly 580 advantageously enables any type of external equipment (e.g. propulsion units 260, illumination devices, imaging devices, instrumentation, sensors, etc.) to be adjustably positioned on the body 513. Again, the flexibility, versatility, usefulness, and overall mission performance of the submersible vehicle is significantly enhanced.

Although specific embodiments of, and examples for, the invention are described herein for illustrative purposes, various equivalent modifications are possible within the scope of the invention, as those skilled in the relevant art will recognize. The teachings provided herein of the invention can be applied to other arcuate winged submersible vehicles, not necessarily the exemplary arcuate winged submersible vehicles described above and shown in the figures. In general, in the following claims, the terms used should not be construed to limit the invention to the specific embodiments disclosed in the specification and the claims, but should be construed to include all submersible vehicles that operate within the broad scope of the claims. Accordingly, the invention is not limited by the foregoing disclosure, but instead its scope is to be determined by the following claims.

What is claimed is:

1. A submersible vehicle adapted to operate within a fluid medium, comprising:

an enclosed, substantially fluid-tight hull surrounding an interior region and having an external surface including a non-planar portion, the hull further having a channel formed at least partially within the non-planar portion, the channel being at least partially disposed below an upper surface of the fluid medium during operation of the submersible vehicle within the fluid medium;

a sliding member disposed within the channel and moveable along at least a portion of the channel; and a mounting assembly attached to the sliding member and including an engagement member coupled to the sliding member, the engagement member being moveable between a first position wherein the sliding member is moveable within the channel and a second position wherein the sliding member is secured in a fixed position within the channel.

2. The vehicle of claim 1 wherein the channel is integrally formed within the external surface of the hull.

3. The vehicle of claim 1 wherein the channel comprises a longitudinal channel.

4. The vehicle of claim 1 wherein the channel comprises an at least partially circumferential channel.

5. The vehicle of claim 1 wherein the sliding member includes an engagement surface that engages a locking surface of the channel.

6. The vehicle of claim 1 wherein the engagement member comprises a threaded member.

7. The vehicle of claim 1, further comprising a tow point assembly attached to the mounting assembly.

8. The vehicle of claim 1, further comprising a wing attached to the mounting assembly.

9. The vehicle of claim 1, further comprising a tail assembly attached to the mounting assembly.

10. The vehicle of claim 1, further comprising a propulsion unit attached to the mounting assembly.

11. The vehicle of claim 1, further comprising a support attached to the channel and projecting forwardly of the hull.

12. The vehicle of claim 1, further comprising a forward payload assembly including a support attached to the channel and projecting forwardly of the hull, the forward payload assembly including an imaging device.

13. A submersible vehicle adapted to operate within a fluid medium, comprising:

an enclosed, substantially watertight hull surrounding an interior region and having a non-planar external surface configured to form an elongated channel at least partially within the non-planar external surface, the channel being at least partially disposed below an upper surface of the fluid medium during operation of the submersible vehicle within the fluid medium;

a sliding member at least partially disposed within the channel and moveable along at least a portion of the channel, and a mounting assembly attached to the sliding member and including an engagement member coupled to the sliding member, the engagement member being selectively engageable between a first position wherein the mounting assembly is moveable along the channel, and a second position wherein the mounting assembly is secured in a fixed position along the channel.

14. The apparatus of claim 13 wherein the hull comprises a substantially enclosed hull of a submersible vehicle.

15. The apparatus of claim 13 wherein the channel is integrally formed within the hull.

16. The apparatus of claim 13 wherein the hull extends along a longitudinal direction and the channel comprises a longitudinally-extending channel.

17. The apparatus of claim 13 wherein the non-planar has a circumferential portion and the channel comprises an at least partially extending channel.

18. The apparatus of claim 13, further comprising a tow point assembly attached to the mounting assembly.

19. The apparatus of claim 13, further comprising a propulsion unit attached to the mounting assembly.

20. The apparatus of claim 13, further comprising a payload assembly including a support attached to the channel and projecting forwardly of the hull, the payload assembly including an imaging device.

* * * * *